US005725212A

United States Patent [19]

Garrett

[11] Patent Number: 5,725,212

[45] Date of Patent: Mar. 10, 1998

[54] RANDOM NUMBER SELECTOR

[76] Inventor: Peter A. Garrett, 148 Palos Verdes Blvd., #8, Redondo Beach, Calif. 90277

[21] Appl. No.: 536,568

[22] Filed: Sep. 29, 1995

[51] Int. Cl.[6] ..... A63F 3/06

[52] U.S. Cl. ..... 273/144 R; 273/144 B; 273/138.2; 273/148 R

[58] Field of Search ..... 273/144 R, 144 A, 273/144 B, 138 A, 148 R, 457, 269, 138.2; 70/456 R, 457, 459; D3/207, 208

[56] References Cited

U.S. PATENT DOCUMENTS

| | | | |
|---|---|---|---|
| 5,007,642 | 4/1991 | Henry et al. | 273/148 R |
| 5,039,101 | 8/1991 | Potter | 273/457 |
| 5,265,877 | 11/1993 | Boylan et al. | 273/144 B |
| 5,328,172 | 7/1994 | Jagiella | 273/144 B |
| 5,454,567 | 10/1995 | Adell | 273/144 B |

FOREIGN PATENT DOCUMENTS

| | | | |
|---|---|---|---|
| 2428877 | 2/1980 | France | 273/144 B |

*Primary Examiner*—William M. Pierce
*Attorney, Agent, or Firm*—Roger A. Marrs

[57] ABSTRACT

A selector apparatus is disclosed herein for randomly selecting a predetermined quantity of numbered spheres or balls which includes a cylindrical housing having an internal storage compartment occupied by the numbered spheres in a liquid solution such as oil. The compartment is connected to a display chamber by a funnel whereby the numbered spheres are introduced to the display chamber in a randomly selected order. At least the display chamber is defined by a transparent window permitting visual observation of the selected spheres. The storage compartment is of greater area than the display chamber and a support base or chain device may support the apparatus.

4 Claims, 1 Drawing Sheet

FIG. 1
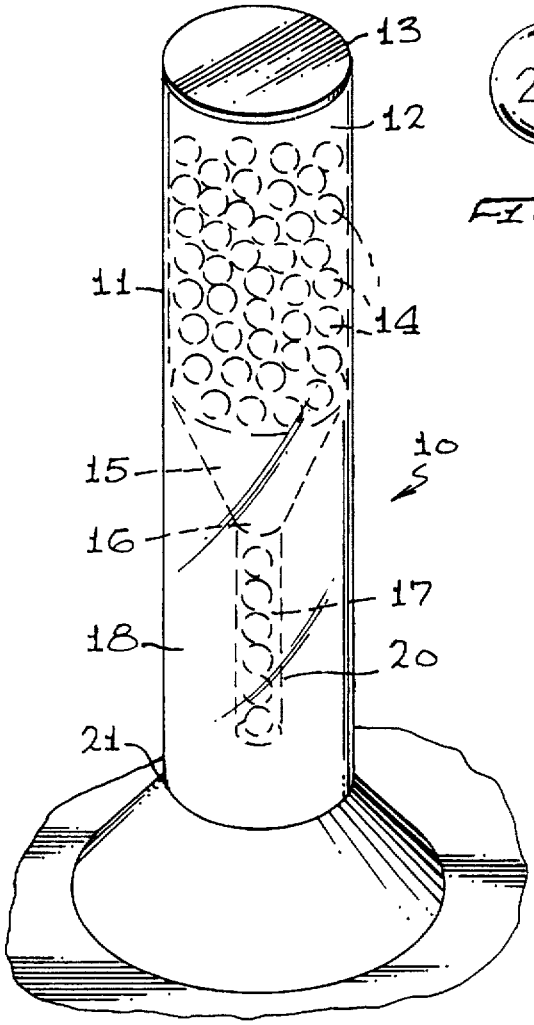
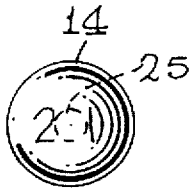
FIG. 4
FIG. 2
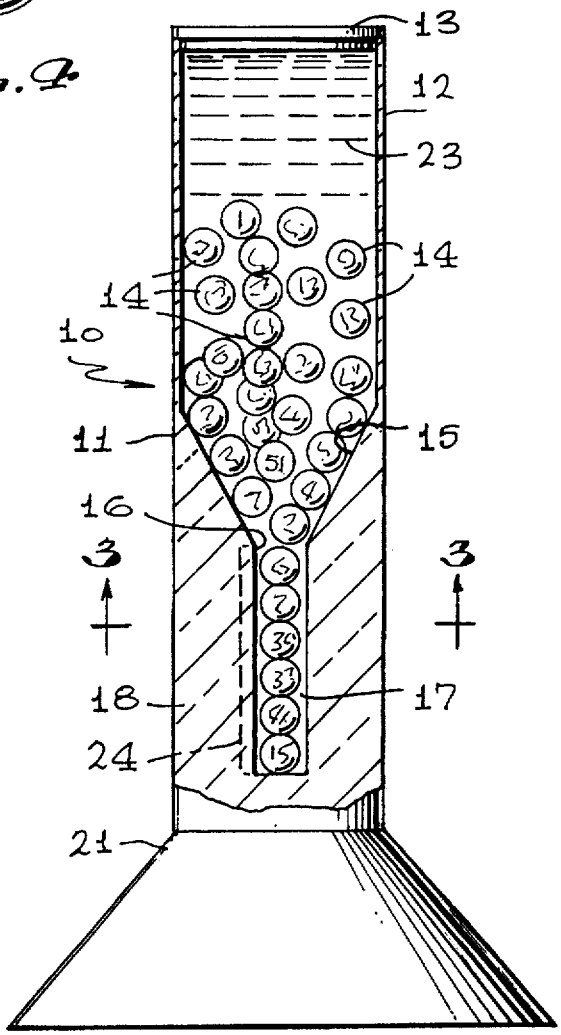
FIG. 5
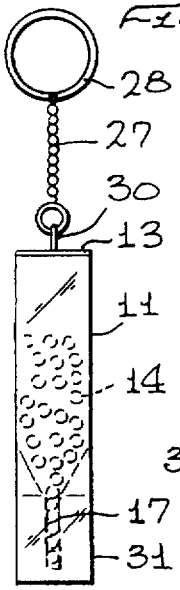
FIG. 6
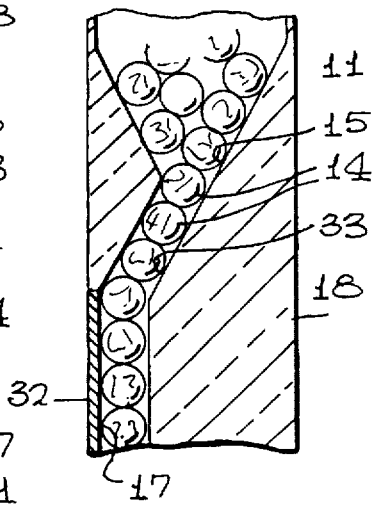
FIG. 3
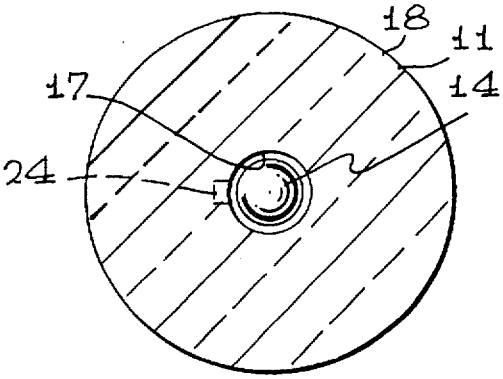

RANDOM NUMBER SELECTOR

BACKGROUND OF THE INVENTION

1. Field of the Invention

The present invention relates to random number selectors or generators, and more particularly to a device that includes a storage compartment filled with a liquid, such as oil, for supporting and holding a plurality of numbered spheres for selection and conduction to a display area.

2. Brief Description of the Prior Art

In the past, it has been the conventional practice for many people to play state-sponsored lottery games and other games involving the selection of random numbers. Usually the selection is made from a spinning wheel, a rotation of a sphere containing a plurality of numbered balls or from selecting numbers on slips of paper contained within a bowl or hat. Choosing the numbers to play in the games is part of the procedure and many devices have been employed for scrambling or mixing a quantity of numbered articles which are then randomly chosen by manual means. In some instances, containers are employed and these are disclosed in U.S. Pat. Nos. 5,335,912 and 5,062,635.

Although the above devices are successful for randomly choosing numbers, many difficulties and problems have been encountered when using such devices which stem largely from the fact that the mixing or scrambling of the numbered articles, such as numbered balls, for example, causes extreme wear on the articles and causes rapid deterioration of the numbers displayed. Also, by stirring or mixing the balls rapidly, the players cannot observe relative locations of the numbered articles and the factor of anticipation is lost. In other instances, prior devices do not permit self support on a table or the like while the mixed numbered articles are randomly located into a display area.

Therefore, a long-standing need has existed to provide a novel random number selector which will permit the mixing or stirring of numbered articles without causing deterioration or loss of the numbers on the articles and which will permit the numbered articles to be removed from the major quantity and displayed in an orderly manner. A support is also useful in maintaining the device in a suitable fashion so that the players can view the selected numbered articles.

SUMMARY OF THE INVENTION

Accordingly, the above difficulties and problems are avoided by the present invention which provides a novel random number selector which includes a cylindrical housing defining an internal storage compartment which is occupied by a quantity of numbered articles, such as balls, spheres or the like. The compartment is further occupied by a viscous liquid, such as water, oil or the like and the compartment permits the numbered articles to be mixed or stirred when the housing is shaken or tilted back and forth. A display chamber is included which is defined by a transparent window and selected numbered articles are conducted to the display chamber by a funnel in an orderly fashion so that the random numbers appear through the transparent window. A base or support is included for self-supporting of the housing.

Therefore, it is among the primary objects of the present invention to provide a novel random number selector which includes a storage compartment for a quantity of numbered articles that are surrounded by a fluid, such as water, oil or the like so that the numbered articles will not violently rub or engage with one another wherein such engagement would cause damage and deterioration of the article.

Another object of the present invention is to provide a novel random number selector having a quantity of numbered articles within a viscous fluid wherein the quantity may be stirred or mixed with selected articles passing through a funnel into a viewing or observation display area or chamber.

Yet another object of the present invention is to provide a random number selector which includes a cylindrical housing defining an internal compartment occupied by numbered articles which may be stirred or mixed therein and wherein the stirring or mixing occurs within a fluid environment to prevent frictional engagement of the external surfaces of the numbered articles with each other.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the novel apparatus of the random number selector of the present invention;

FIG. 2 is a longitudinal cross-sectional view of the selector shown in FIG. 1;

FIG. 3 is a transverse cross-sectional view of the selector shown in FIG. 2 as taken in the direction of arrows 3—3 thereof;

FIG. 4 is a front elevational view of a numbered article taking the form of a sphere or ball used in connection with the selector shown in FIGS. 1 and 2;

FIG. 5 is a front elevational view of another embodiment of the invention illustrated as being supported by a chain; and FIG. 6 is a fragmentary sectional view showing a connection between the funnel and the viewing display chamber utilized in the selector shown in FIGS. 1 and 2.

DESCRIPTION OF THE PREFERRED EMBODIMENT

Referring to FIG. 1, the novel random number selector of the present invention is illustrated in the general direction of arrow 10 which includes an elongated cylindrical housing 11 having an upper portion 12 which may be opaque or transparent, and includes a storage compartment internally disposed and which includes a permanent cap 13. Within the storage compartment, there is provided a multiplicity of balls or spheres, such as indicated by numeral 14, which are individually provided with different indicia, such as numbers, letters or the like. Multiple numbers of the same value are carried on the external surface of each of the spheres or balls 14 and the end of the storage compartment from its end carrying cap 13 is in communication with the enlarged end of a funnel member 15 having a spout 16 terminating at one end of a display chamber 17. The multiplicity of spheres 14 enter the funnel 15 and, via gravity, proceed into the display chamber 17. The display chamber includes a front plate or panel which is transparent so that the numbers of the spheres or balls are visible externally of the cylinder 11. In this fashion, the material of the cylinder surrounding the funnel 15 and the display chamber may be of an opaque or transparent material. This lower end of the cylinder is indicated by numeral 18. The transparent panel is indicated by numeral 20. The entire cylinder 11 may be supported on a surface by a base 21 so that the display area and the numbered spheres can be viewed while the device is supported.

Referring now in detail to FIG. 2, it is to be particularly noticed that the inventive concept includes occupying the storage compartment indicated by numeral 23 with a viscous fluid, such as water, oil or the like. The fluid completely surrounds all of the spheres so that the spheres do not come into intimate contact with one another with impacting forces that would normally mar or damage the indicia or numbers carried on the external surface thereof. Also, it is noticed that the spheres are directed towards the funnel 15 and the enlarged opening thereof by gravitational forces and eventually are directed into the display area or chamber 17. The introduction of the spheres into the display chamber is random and depends on the location of the nearest spheres to the chamber as the device is shaken, stirred or jostled so that after mixing, a limited number of spheres are permitted to be introduced into the chamber 17. As an assist in directing the balls or spheres into the chamber, magnetic means may be provided which may include a permanent magnet 24 located adjacent to the chamber 17 which exerts a magnetic pull on the spheres via a magnetic material 25 carried on each ball, such as shown in FIG. 4. The material may be metal and carried internally of the sphere. Therefore, as the spheres are directed towards the chamber 17 within the funnel 15, the magnetic forces of the traction will urge the nearest spheres into the chamber 17. This will assist the gravitational forces which move the spheres into the chamber and will avoid jamming of the spheres within the funnel or entrance to the chamber 17. The extreme end of chamber 17, as indicated by numeral 26, includes a stop which causes the lowermost sphere of a selection of spheres to remain within the chamber so that additional randomly chosen spheres will rest on top of one another within the chamber.

FIG. 3 illustrates that the magnet 24 is immediately adjacent to the chamber 17 and that the material of the lower portion 18 of the cylinder is composed of a transparent material so that the indicia or numbers on each of the respective spheres can be visible to players or users. However, as mentioned above, a separate panel 20 may be incorporated into the lower portion 18 so that the surrounding portion is of an opaque material permitting viewing only through the panel 20. The panel may also be composed of a magnifying lens structure so that the numbers are enlarged to the viewer. Such a magnification would be of assistance in the event the cylinder 11 is reduced in size as well as the spheres and the indicia carried thereon, such as when the device is used at the end of a chain 27, as shown in FIG. 5. In this instance, the device may be used as a keychain having a loop 28 at one end of the chain and an attachment or connector 30 carried at the opposite end of the chain joining with the top 13 of the selector. The elongated cylinder 11 is identical to that previously described as well as the spheres and the viewing chamber. The composition of the material around the viewing chamber 17 is preferably composed of material which intensifies or magnifies the indicia or numbers on each of the respective spheres which have been randomly selected for display within the chamber. This material is indicated by numeral 31 carried on the end of the cylinder 11.

With respect to FIG. 6, another version of the device is illustrated wherein the display or viewing chamber 17 is occupied by the numbered spheres 14 wherein the chamber is offset from the central longitudinal axis of the cylinder 11 as well as the funnel 15. This construction provides that the randomly selected spheres 14 can be brought adjacent to a magnifying panel 32 which forms a portion of the chamber 17 in combination with the surrounding material 18 of the cylinder. The material of portion 18 may be opaque or transparent; however, the panel 32 is intended to be a lens structure. The funnel 15 is connected to the end of the chamber 17 by a passageway 33 which is angularly disposed with respect to the vertical axes of the chamber 17 and the central longitudinal axis of the cylinder 11. As described above, the magnet 24 may be placed on the opposite side of chamber 17 from the panel 32 which will enhance drawing spheres from the funnel 15 into the viewing chamber 17. Multiple magnets 24 may be arranged in fixed spaced-apart relationship about the viewing chamber 17 in either embodiments shown in FIG. 2 or FIG. 6.

Therefore, it can be seen that the random number selector of the present invention provides a means for randomly selecting numbers in association with play of currently popular lottery games or the like. The selector provides a convenient alternative to using the lottery's own random selection, or "quik-pik" selections on conventional machines. The selector is designed as a manner for a lottery player randomly select any quantity of numbers. It consists of a cylindrical plastic body or member having a partially hollow interior constituting a storage compartment which is filled with water or any other fluid into which a multiplicity of small or tiny numbered spheres or balls may be placed. The fluid completely surrounds the cluster or multiplicity of spheres and the outer shell forming the storage container is transparent to allow the spheres to be readily viewed. The lower end of the cylinder beneath the storage or internal chamber is connected with a funnel that leads into a narrow display chamber. The player or user can now record the numbers displayed for use in the lottery game.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A random number selector comprising:

a cylindrical housing having an internal storage compartment, a display chamber and a funnel interconnecting said storage compartment with said display chamber;

a multiplicity of numbered spheres loosely disposed in said storage compartment adapted to be stirred wherein a limited number of said spheres adapted and capable of being introduced into said display chamber via said funnel from said storage compartment filled with a fluid submerging said multiplicity of spheres therein;

said fluid occupying said funnel and said display chamber about said limited number of spheres;

means for directing said limited number of spheres into said display chamber;

magnifying means carried on said housing immediately adjacent to said display chamber for visually enlarging numbers carried on each sphere of said limited number;

said limited number of spheres are capable of being randomly separated from said multiplicity of spheres; and said means for directing said limited number of spheres includes magnetic material embedded in each of said spheres and a magnet disposed in said housing adjacent said display chamber whereby a magnetic field force draws said limited number of spheres through said funnel into said display chamber.

2. The invention as defined in claim 1 wherein:

said display chamber is disposed adjacent of said housing and having a longitudinal vertical axis offset from a longitudinal vertical axis of said cylindrical housing; and a cylindrical passageway connecting said funnel with said display chamber.

3. The invention as defined in claim 1 including:

means connected to said housing for support chosen from:

a. a chain b. a fixed base.

4. The invention as defined in claim 1 wherein:

said housing is opaque about said display chamber with said magnifying means being transparent; and said housing surrounding said storage compartment being translucent or transparent.

* * * * *